US006323725B1

(12) United States Patent
Goldblatt et al.

(10) Patent No.: US 6,323,725 B1
(45) Date of Patent: Nov. 27, 2001

(54) CONSTANT TRANSCONDUCTANCE BIAS CIRCUIT HAVING BODY EFFECT CANCELLATION CIRCUITRY

(75) Inventors: Jeremy Mark Goldblatt; Seyfollah Bazarjani, both of San Diego, CA (US)

(73) Assignee: Qualcomm Incorporated, San Diego, CA (US)

( * ) Notice: Subject to any disclaimer, the term of this patent is extended or adjusted under 35 U.S.C. 154(b) by 0 days.

(21) Appl. No.: 09/283,090

(22) Filed: Mar. 31, 1999

(51) Int. Cl.[7] ..... G05F 1/10
(52) U.S. Cl. ..... 327/543
(58) Field of Search ..... 323/312, 313, 323/314, 315; 327/530, 534, 535, 537, 538, 540, 541, 542, 543, 545, 546

(56) References Cited

U.S. PATENT DOCUMENTS 4,795,918 * 1/1989 Menon et al. ..... 307/297
5,594,382 * 1/1997 Kato et al. ..... 327/541
5,672,960 * 9/1997 Manaresi et al. ..... 323/313

OTHER PUBLICATIONS

"Understanding Wide–Band MOS Transistors", by John M. Steininger, Circuits and Devices, May 1990 pp. 26–31.

* cited by examiner

*Primary Examiner*—Jeffrey Zweizig
(74) *Attorney, Agent, or Firm*—Philip R. Wadworth; Charles D. Brown; Brian S. Edmonston

(57) ABSTRACT

A bias cell for use in biasing all NMOS differential pair is configured to substantially eliminate variations in transconductance caused by body effects. In one example, a voltage threshold mismatch between NMOS devices of the bias cell is substantially eliminated to thereby reduce variations in transconductance caused by body effects. To reduce the voltage threshold mismatch, the bias cell includes a transconductance-setting resistor connected between gates of a pair of current source devices. Circuitry is connected to the resistor for applying a voltage across the resistor. A bias line connects a signal output from the bias circuit to the differential pair. By positioning the transconductance-setting resistor between the gates of the NMOS devices of the bias cell, rather than between the source of one of the NMOS devices and ground as in many conventional constant transconductance bias cells, a voltage differential between the sources is eliminated thereby removing the threshold voltage mismatch and reducing body effect variations. In another example, a source voltage mismatch between sources of NMOS devices of the bias cell and sources of NMOS devices of the differential pair is substantially eliminated to thereby also reduce variations in transconductance caused by body effects. To reduce source mismatch, the bias cell includes source follower circuitry connected to sources of the pair of current source devices. The source follower circuitry has a gate voltage set to input the common mode voltage of the differential pair. By providing the source follower circuitry, any absolute differences between the sources of the NMOS devices of the bias cell and the sources of the differential pair is eliminated thereby further reducing body effect variations.

11 Claims, 4 Drawing Sheets

CONSTANT TRANSCONDUCTANCE BIAS CIRCUIT HAVING BODY EFFECT CANCELLATION CIRCUITRY

BACKGROUND OF THE INVENTION

I. Field of the Invention The invention generally relates to integrated circuits and in particular to constant transconductance CMOS bias circuits for biasing NMOS differential pairs such as those employed in differential amplifiers.

II. Description of the Related Art NMOS differential pairs ac commonly employed within integrated circuits as high-speed components of differential amplifiers, sample and hold circuits, and the like. Constant transconductance bias circuits are employed in connection with the NMOS differential pairs for reducing or eliminating temperature and process variations of the gm of the differential pair. By way of example, the operation of a constant transconductance bias circuit is described in the following in connection with a differential pair containing an NMOS differential pair.

FIG. 1 illustrates a simple NMOS differential pair 10. The pair of NMOS devices 12 and 14 have rates connected to a pair of voltage input lines 16 and 18, respectively. A transconductance ($g_m$) of the differential pair is $\Delta i/\Delta V_{in}$ where $\Delta V_{in}$ is the input voltage differential and $\Delta i$ is the current through one of the devices of the differential pair. To prevent temperature and process variations from affecting the gm of the differential pair, the pair is biased by a bias voltage applied to the gate of an NMOS device 24 connected between the sources of devices 16 and 18 and ground. The bias voltage is generated by a bias circuit 26 which operates to generate a constant transconductance ($g_m$) bias signal despite temperature and process variations. Briefly, the bias circuitry includes a pair of NMOS devices 28 and 30 connected between a pair of nodes A and B and ground, respectively. A pair of PMOS devices 32 and 34 arc connected, respectively, between nodes A and B and the positive voltage source. Gates of NMOS devices 28 and 30 are connected to node A. Gates of NMOS devices 32 and 34 are connected to B. A transconductance-setting resistor 36 is connected between the source of device 30 and ground. Resistor 36 is typically located off-chip to permit the resistance to be set after chip fabrication for better tolerance.

In use, bias circuitry 26 operates to generate a bias current that sets the transconductances of NMOS devices 12 and 14 of the differential pair to an amount inversely proportional to the resistance of transconductance-setting resistor 36. The bias circuit is, in effect, a modification of a MOS self-biasing Widlar current source, well known in the art. The constant transconductance of the NMOS devices of the differential pair may be established using the following equations (with the various terms in the equations having their standard definitions in the art):

vgs1=vgs2+IR vgs2=vgs1+I·R

Since $$vgs = \sqrt{\frac{2 \cdot I}{B}} - Vt$$

B=$\mu$nCoxW/L and $$\sqrt{\frac{2 \cdot I}{B}} = \frac{1}{2} \cdot \sqrt{\frac{2 \cdot I}{B}} + I \cdot R$$

then

Solving for $$\sqrt{I} = \frac{1}{\sqrt{2 \cdot B \cdot R}}$$

yields $$gm = \sqrt{2 \cdot B \cdot I} = \frac{1}{R}$$

Thus, disregarding body effects the transconductances of the devices of the differential pair are merely inversely proportional to the resistance of the transconductance-setting resistor. Unfortunately, in practical integrated circuits, body effects can pose a significant problem. Briefly, body effects relate to a modification of the threshold voltage Vt caused by a voltage difference between source and substrate. The change in voltage threshold is proportional to the square root of the voltage between the source and the substrate. Differences in voltage between the source and the substrate occurs as a result of voltage drop across transconductance-setting resistor.

In the circuit of FIG. 1, the change in threshold voltage results in two separate problems. The first problem occurs from the variations in source voltage between NMOS devices 28 and 30 of the bias circuitry. Since the source of NMOS device 30 is at a different voltage from that of device 28, the transconductance is not merely proportional to the resistance of resistor 36 but is instead given by the following equation:

$$g_m = \frac{1 + \sqrt{1 + 2 \cdot B \cdot R \cdot vterr}}{2R}$$

$$B = \mu_n Cox \frac{W}{L}.$$

where

This formula for transconductance may be derived from the following set of equations:

vgs1=vgs2+IR−vterr $$vgs = \sqrt{2 \cdot \frac{I}{B}} - vt_0$$

and since $$B = \mu_n Cox \frac{W}{L}.$$

Then $$\sqrt{2 \cdot \frac{I}{B}} = \frac{1}{2} \sqrt{2 \cdot \frac{I}{R}} + I \cdot R - vterr.$$

Solving for $$\sqrt{I} = \frac{\frac{1}{\sqrt{2 \cdot B}} + \sqrt{\frac{2}{B} + R \cdot vterr}}{2R}$$

yields $$g_m = \sqrt{2 \cdot B \cdot I}$$

and finally $$g_m = \frac{1 + \sqrt{1 + 2 \cdot B \cdot R \cdot vterr}}{2R}.$$

The second body effect problem occurs as a result of absolute differences between the sources of devices 28 and 30 of the bias circuitry and devices 12 and 14 of the differential pair. The absolute current generated in the bias cell is proportional to the threshold voltage, and therefore any variances between the source voltages will result in a different transconductance value. Since the input common mode voltage to the differential pair is fixed, the source voltage of devices 12 and 14 will vary with process causing a non-tracking transconductance. As a result, temperature and process variations are not fully compensated for by the CMOS bias circuitry of FIG. 1 resulting in uncertainties in the accuracy of the output of the differential pair.

As can be appreciated, it would be highly desirable to provide an improved constant transconductance bias circuit for use with an NMOS differential pair that substantially eliminates variations caused by body effects and it is to that end that aspects of the invention are primarily directed.

SUMMARY OF THE INVENTION

In accordance with a first aspect of the invention, a bias cell for use in biasing a differential pair, such as an NMOS differential pair, is provided wherein a voltage threshold mismatch between NMOS devices of the bias cell is substantially eliminated to thereby reduce variations in transconductance caused by body effects. The bias cell includes a pair of current source devices with a transconductance-setting resistor connected between gates of the pair of current source devices. The current through the resistor generates a voltage needed to operate the gm bias cell. A bias line connects the voltage-setting circuitry to the differential pair.

By positioning the transconductance-setting resistor between the gates of the NMOS devices of the bias cell, rather than between the source of one of the device and ground, a voltage differential between the sources is eliminated thereby removing any threshold voltage mismatch. Hence, body effect variations that might affect the voltage threshold do not cause a significant change in the transconductance of the bias cell and hence do not cause a significant change in the output bias current.

In accordance with a second aspect of the invention, a bias cell for use in biasing an NMOS differential pair is provided wherein a source voltage mismatch between sources of the NMOS devices of the bias cell and sources of NMOS devices of the differential pair is substantially eliminated to thereby also reduce variations in transconductance caused by body effects. The bias cell includes a pair of current source devices with source follower circuitry connected to sources of the pair of current source devices. The source follower circuitry has a gate voltage set to input a common mode voltage of the differential pair. A bias line connects the source follower circuitry to the differential pair.

By providing the source follower circuitry with gate voltage set to input the common mode voltage, any absolute differences between the sources of the NMOS devices of the bias cell and the sources of the differential pair is eliminated thereby further reducing variations in transconductance caused by body effects.

In some embodiments, the bias cell includes both the transconductance-setting resistor and voltage-setting circuitry of the first aspect of the invention and the source follower circuitry of the second aspect of the invention.

BRIEF DESCRIPTION OF THE DRAWINGS

The features, objects, and advantages of the present invention will become more apparent from the detailed description set forth below when taken in conjunction with the drawings in which like reference characters identify correspondingly throughout and wherein.

DETAILED DESCRIPTION OF THE PREFERRED EMBODIMENTS

Referring to the remaining figures, exemplary embodiments of the invention will now be described.

Figure 2:
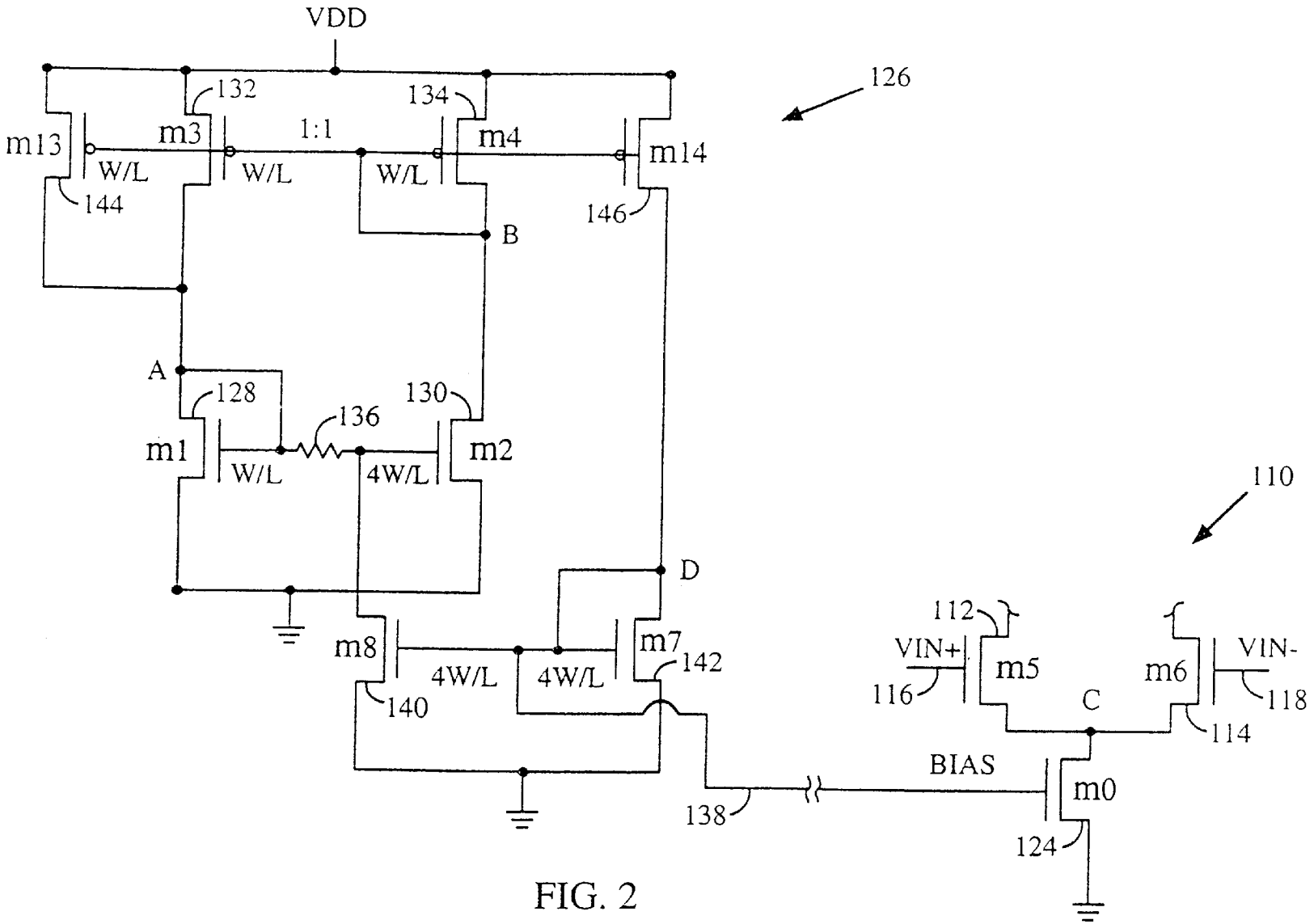
FIG. 2 illustrates a differential pair with a constant transconductance bias circuit configured in accordance with a first exemplary embodiment of the invention wherein a voltage threshold mismatch within the bias circuit is substantially eliminated.

FIG. 2 illustrates a constant transconductance bias circuit 126 for use with a differential pair 110 having an NMOS differential pair with the bias Circuit configured to substantially eliminate voltage threshold mismatches resulting from body effects. Differential pair 110 includes a pair of NMOS devices 112 and 114. A pair of differential input lines 116 and 118 are connected, respectively, to gates of devices 112 and 114 providing an input voltage differential of $\Delta V_{in}$. The differential pair operates to generate a differential current $B_I$ (based on a $\Delta V_{in}$, where $gm=\Delta i/\Delta V_{in}$) between signals received along lines 116 and 118. An additional NMOS device 124 is connected between a node C coupled between sources of the differential pair and ground for receiving the appropriate biasing current to generate the constant gm in the differential pair.

Constant transconductance bias circuit 126 operates as a current mirror to provide the bias signal for use by differential pair 110. Bias circuit 126 includes a primary pair NMOS of devices 128 and 130 connected between nodes A and B and ground respectively. The bias circuit also includes a pair of primary PMOS devices 132 and 134 connected between nodes A and B and the positive voltage source respectively. Gates of the primary NMOS devices are cross-coupled to node A. Gates of the primary PMOS devices are connected to node B. A transconductance-setting resistor 136 is connected between gates of primary NMOS devices 128 and 130 as shown. Hence, unlike certain conventional bias circuits wherein the transconductance-setting resistor is connected between the source of one of the NMOS devices and ground, the resistor of bias circuit 126 is connected directly to the gates of both NMOS devices 128 and 130. With the resistor positioned between the gates, the threshold voltages for the two primary NMOS devices are therefore substantially equalized. Hence the aforementioned body effect variations resulting from differences in threshold voltage do not occur. Thus a bias current generated by the circuit is substantially immune from body effect variations in addition to temperature and process variations.

To ensure that a bias current is generated a voltage drop across resistor 136 is necessary. Accordingly, voltage-setting circuitry is provided within bias circuit 126. The voltage-setting circuitry includes a pair of secondary NMOS devices 140 and 142 having sources connected to ground and a pair of secondary PMOS devices 144 and 146 having sources connected to the positive voltage source. Gates of the secondary NMOS devices are connected together. Gates of the secondary PMOS devices are connected together and are connected to gates of the primary PMOS devices. A drain of secondary PMOS device 144 is connected to node A. A drain of secondary NMOS device 140 is connected to the gate of primary NMOS device 130. Drains of secondary devices 142 and 146 are connected together. Finally, the gates of secondary NMOS devices 140 and 142 are connected to a node D interconnecting, the drains of devices of 142 and 146. A bias line 138 connects the gates of NMOS devices 140 and 142 to the gate of biasing NMOS device 124 of the differential pair. With this configuration the various secondary NMOS devices and PMOS devices function as a current mirror for generating a voltage across the transconductance-setting resistor to thereby ensure a current through the resistor and along the bias line 138.

Thus FIG. 2 illustrates a constant transconductance bias cell wherein voltage threshold variations resulting from body effects are substantially eliminated such that the bias cell compensates not only for temperature and process variations, but for body effects as well. In one example, primary NMOS device 128 and primary PMOS devices 132 and 134 all have width to length ratios of W/L with primary NMOS device 130 having a width to length ratio of 4W/L. Secondary NMOS devices also have width to length ratios of 4W/L. Secondary PMOS devices have width to length ratios of W/L. Transconductance-setting resistor 136 may be positioned off chip to allow the value of the resistance to be set following chip fabrication.

Figure 3:
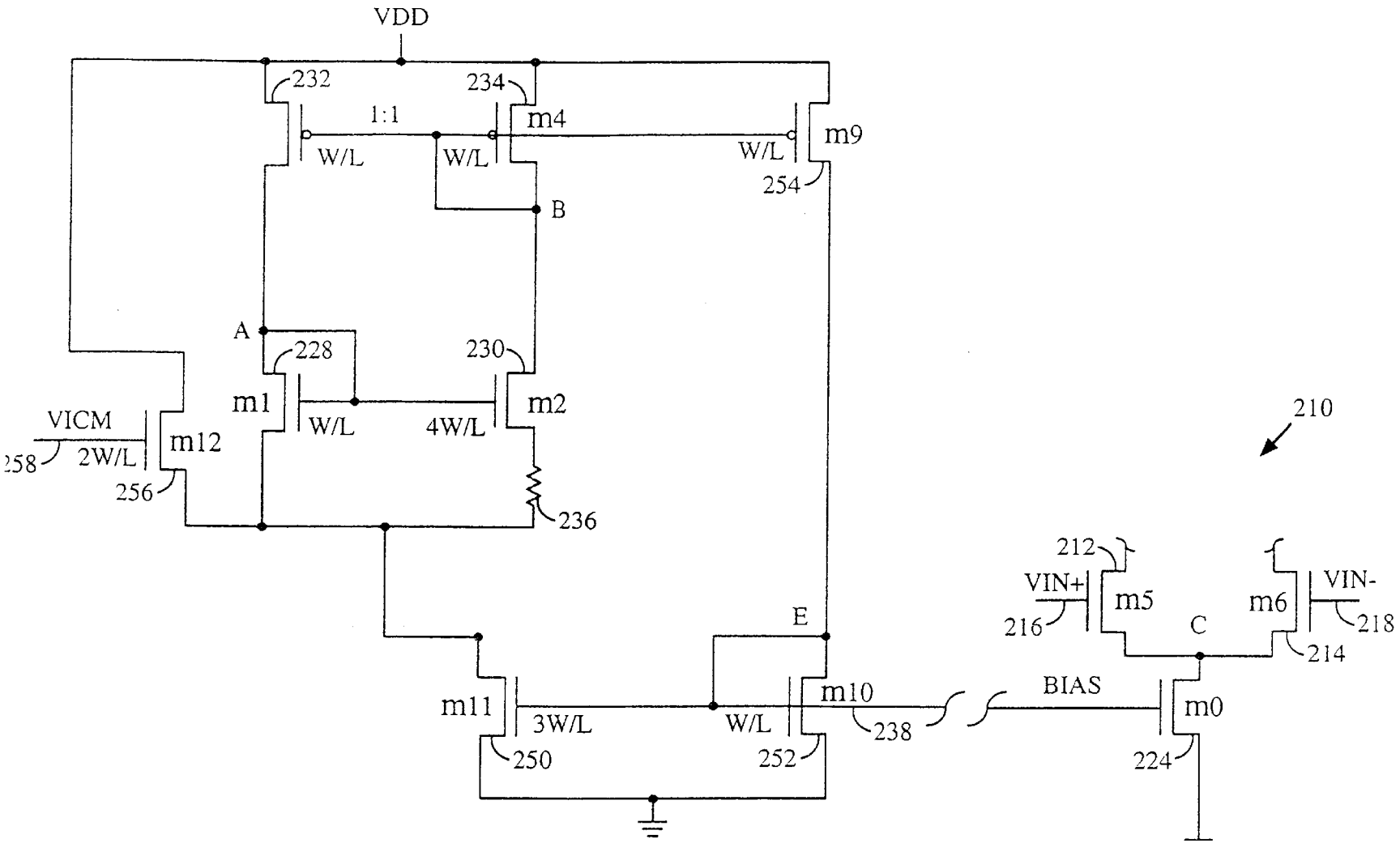
FIG. 3 illustrates a differential pair with a constant transconductance bias circuit configured in accordance with a second exemplary embodiment of the invention wherein a source voltage mismatch between the bias circuit and the differential pair is substantially eliminated.

FIG. 3 illustrates an alternative constant transconductance bias circuit 226 for use with a differential pair 210 wherein circuitry is included to ensure that source voltages for primary NMOS devices within the bias circuit are substantially equal to source voltages of NMOS devices within the differential pair such that body effect variations that might otherwise result from a source voltage mismatch are substantially eliminated. The differential pair and much of the circuitry of the constant transconductance bias circuit is the same as with the preceding embodiment and will not be re-described in detail.

Briefly, the differential pair 210 includes NMOS devices 212 and 214 receiving differential inputs along lines 216 and 218 and a biasing NMOS device 214. Bias circuitry 226 includes primary NMOS devices 228 and 230 and primary PMOS devices 232 and 234 along with a transconductance-setting resistor 236. Unlike the preceding embodiment wherein the resistor is positioned between the gates of the primary NMOS devices resistor 236 is connected to a source of NMOS device 230.

To eliminate differences between the source voltages of the primary NMOS devices of the bias circuit and the NMOS devices of the differential pair, source follower circuitry is provided. The source follower circuitry includes a pair of secondary NMOS devices 250 and 252 having sources connected to ground and a single secondary PMOS device 254 connected between device 252 and the positive voltage source. The source follower circuitry additionally includes another NMOS device 256 connected, as shown, between the positive voltage source and the drain of NMOS device 250. A gate of device 256 is connected to a common mode voltage input line 258 for receiving the common mode voltage associated with the signals provided to the differential pair along lines 216 and 218.

Figure 1:
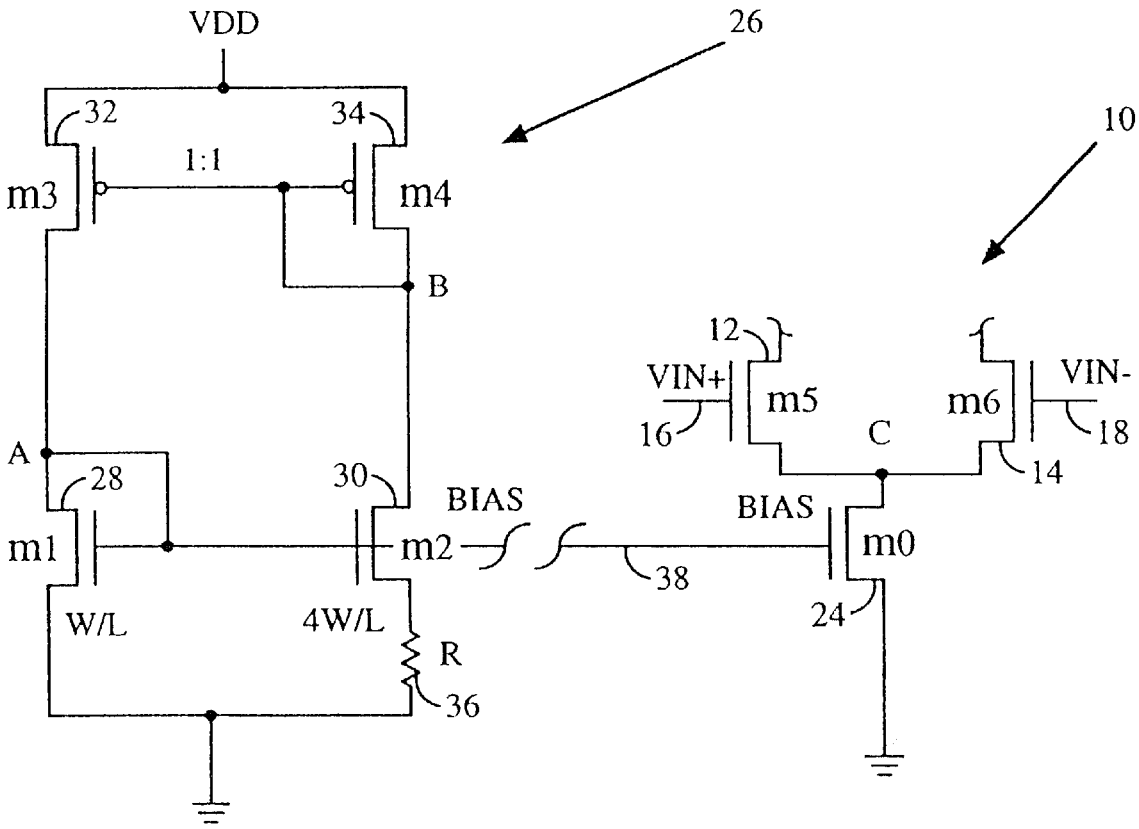
(PRIOR ART) FIG. 1
FIG. 1 illustrates a conventional differential pair with constant transconductance bias circuitry.

With this configuration, the source follower circuitry operates to equalize source voltages of the primary NMOS devices of the bias circuitry to that of the NMOS devices of the differential pair. Hence, a bias current signal generated by the bias circuitry is substantially unaffected by process and temperature variations as well as body effect variations that may result in source voltage mismatches. A bias current line 238 interconnects the gates of secondary NMOS devices 250 and 252 to the gate of bias device 214 of the differential pair for coupling a bias current into the differential pair. In one example, devices 252 and 254 have width to length ratios of W/L. Device 250 has a width to length ratio of 3W/L and device 256 has a width to length ratio of 2W/L. The other devices have width to length ratios as set forth above in connection with FIG. 1.

Figure 4:
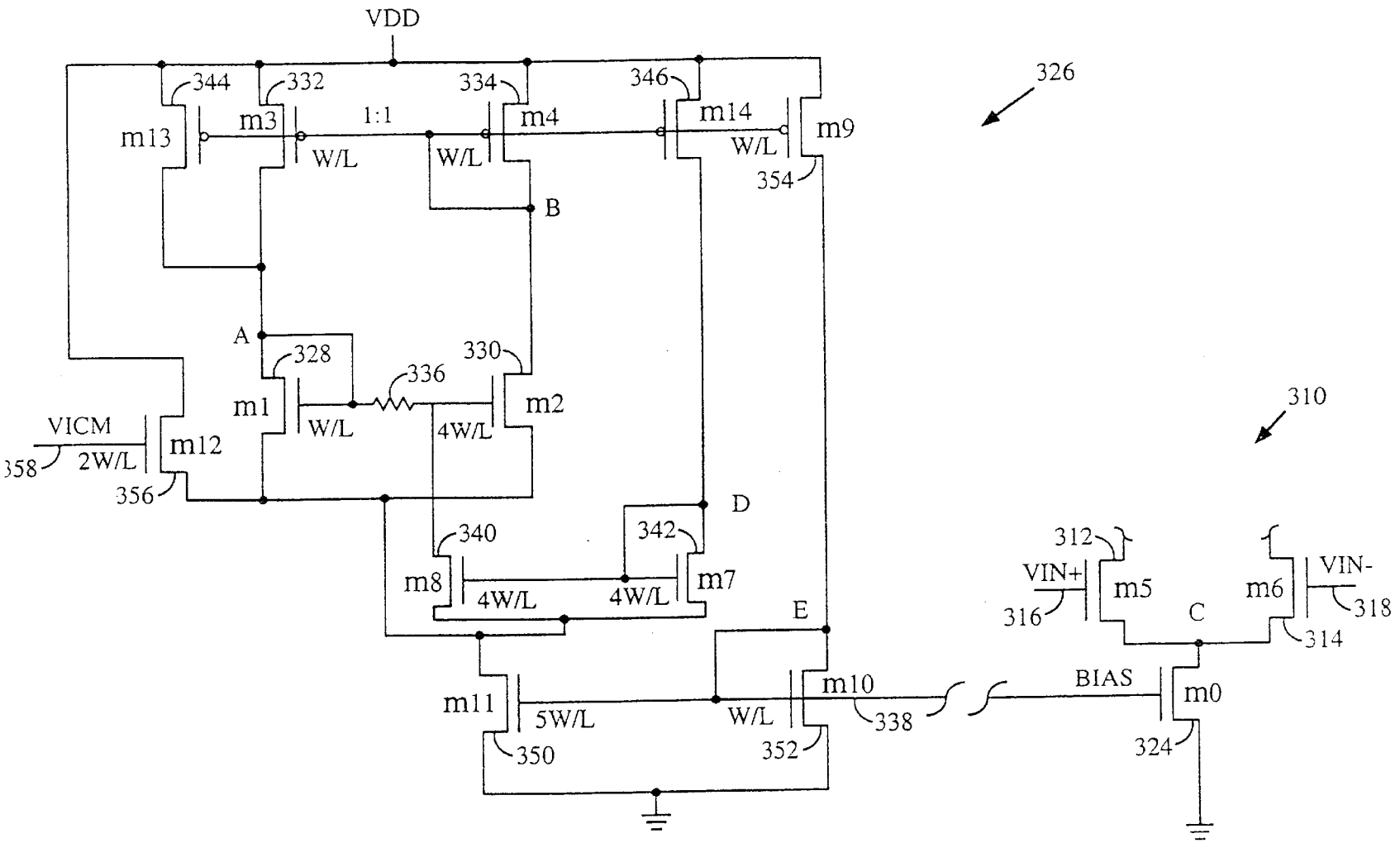
FIG. 4 illustrates a differential pair with a constant transconductance bias circuitry configured in accordance with a third exemplary embodiment of the invention wherein both voltage threshold mismatches and source voltage mismatches are substantially eliminated.

FIG. 4 illustrates a constant transconductance bias circuit 326 for use with a differential pair 310 wherein the bias circuit compensates for both threshold voltage mismatches and source voltage mismatches arising from body effects. To this end, the bias circuit includes both the modified transconductance-setting resistor and voltage setting circuitry of FIG. 2 and the source follower circuitry of FIG. 3. The bias circuit of FIG. 4 is therefore similar to the circuits of FIGS. 2 and 3 and the circuit components will not be re-described in detail.

Table I provides exemplary device sizes for one specific embodiment constructed in accordance with the schematic of FIG. 4. In other embodiments, other device sizes are appropriate.

TABLE 1

| Device Number | Device Size (W/L) |
|---|---|
| NMOS device 312 (m5) | 10/.5 |
| NMOS device 314 (m6) | 10/.5 |
| NMOS device 324 (m0) | 10/.5 |
| NMOS device 328 (m1) | 10/.5 |
| NMOS device 330 (m2) | 40/.5 |
| PMOS device 332 (m3) | 20/.5 |
| PMOS device 334 (m4) | 20/.5 |
| NMOS device 340 (m8) | 10/.5 |
| NMOS device 342 (m7) | 10/.5 |
| PMOS device 344 (m13) | 20/.5 |
| PMOS device 346 (m14) | 20/.5 |
| NMOS device 350 (m11) | 10/.5 |
| NMOS device 352 (m10) | 10/.5 |
| PMOS device 354 (m9) | 20/.5 |
| NMOS device 356 (m12) | 10/.5 |

Thus, various improvements have been described in constant transconductance via circuits for use with NMOS differential pairs. The improvements operate to substantially eliminate variations that might otherwise be caused by body effects. Other features and advantages of the circuit may be provided as well.

The exemplary embodiments have been primarily described with reference to schematic diagrams illustrating pertinent features of the embodiments. It should be appreciated that not all components of a complete implementation of a practical system are necessarily illustrated or described in detail. Rather, only those components necessary for a thorough understanding of the invention have been illustrated and described. Actual implementations may contain more components or, depending upon the implementation, fewer components.

The description of the exemplary embodiments is provided to enable any person skilled in the art to make or use the present invention. Various modifications to these embodiments will be readily apparent to those skilled in the art and the generic principles defined herein may be applied to other embodiments without the use of the inventive faculty. Thus, the invention is not intended to be limited to the embodiments shown herein but is to be accorded the widest scope consistent with the principles and novel features disclosed herein.

What is claimed is:

1. A bias cell for use in biasing a differential pair, the bias cell comprising:

means for generating a source current and including:

a first NMOS device and a second NMOS device connected in parallel between first and second nodes, respectively, and ground and having interconnected gates; and a first and second PMOS devices connected in parallel between the first and second nodes, respectively and a positive voltage source;

means for developing resistance between the interconnected gates of said first and second NMOS devices;

means for applying a voltage across said means for developing resistance to cause said means for generating a source current to also generate a biasing signal in proportion to a resistance developed by said means for developing resistance; and means for applying the biasing signal to the differential pair;

wherein said means for applying a voltage further comprises:

a third NMOS device connected between the gate of said second NMOS device and ground;

a fourth NMOS device connected between a third node and ground;

a third PMOS device connected between the first node and a positive voltage source; and a fourth PMOS device connected between the third node and the positive voltage source; with gates of the third and fourth NMOS device connect together and further connected to the third node; and gates of the third and fourth PMOS devices connected together and further connected to the second node.

2. The bias cell of claim 1, wherein the gates of said first and second NMOS devices are cross-coupled to the first node and the gates of said first and second PMOS devices are cross-coupled to the second node.

3. The bias cell of claim 1, wherein said means for developing resistance comprises:

a transconductance-setting resistor.

4. A bias cell for use in biasing a differential pair, said bias cell comprising:

a pair of current source devices;

a transconductance-setting resistor connected between gates of said pair of current source devices;

circuitry connected to said resistor for applying a voltage across said resistor; and a bias line connecting a voltage output from the pair of current source devices to the differential pair;

wherein said pair of current source devices comprises first and second NMOS devices operably connected in parallel through said resistor between first and second nodes, respectively, and ground; and wherein said bias cell further includes first and second PMOS devices connected in parallel between the first and second nodes, respectively and a positive voltage source; with gates of said first and second NMOS devices connected together and cross-coupled to the first node; and with gates of said first and second PMOS devices connected together and cross-coupled to the second node, said first and second PMOS devices and the first NMOS device all have the same width to length ratio of W/L and wherein the second NMOS device has a width to length ratio of 4W/L.

5. The bias cell of claim 4, wherein said circuitry comprises:

a third NMOS device connected between the gate of said second NMOS device and ground;

a fourth NMOS device connected between a third node and ground;

a third PMOS device connected between the first node and the positive voltage source; and a fourth PMOS device connected between the third node and the positive voltage source; with gates of the third and fourth NMOS device connected together and further connected to the third node; and gates of the third and fourth PMOS devices connected together and further connected to the second node.

6. The bias cell of claim 5 wherein the differential pair comprises:

fifth and sixth NMOS devices connected in parallel to a fourth node, with gates of the fifth and sixth NMOS devices connected to first and second input lines, respectively; and a seventh NMOS device connected between the fourth node and ground, with a gate of the seventh NMOS device connected to the bias cell via the bias line.

7. The bias cell of claim 5, wherein the third and fourth PMOS devices have the same width to length ratio of W/L and wherein the third and fourth NMOS devices have a width to length ratio of 4W/L.

8. The bias cell of claim 6, further including source follower circuitry coupled to the first and second NMOS devices and having a gate voltage set to input a common mode voltage of the differential pair.

9. The bias cell of claim 8, wherein the source follower circuitry comprises:

an eighth NMOS device connected between the positive voltage source and sources of the first and second NMOS devices, and having a gate connected to a common mode voltage input line;

a ninth NMOS device connected between the sources of the first and second NMOS devices and ground;

a tenth NMOS device and a fifth PMOS device connected in series between the positive voltage source and the ground; with gates of the ninth and tenth NMOS devices connected together and also connected to a sixth node between the fifth PMOS device and the tenth NMOS device; and a drain of the ninth NMOS device connected to sources of the third and fourth NMOS devices.

10. The bias cell of claim 9, wherein the fifth and sixth PMOS devices have the same width to length ratio of W/L, the eighth NMOS device has a width to length ratio of 2W/L, and the ninth NMOS device has a width to length ratio of 3W/L.

11. The bias cell of claim 9 further wherein said bias line is connected to gates of the ninth and tenth NMOS devices.

* * * * *